US006980167B2

(12) United States Patent
Brachat et al.

(10) Patent No.: US 6,980,167 B2
(45) Date of Patent: Dec. 27, 2005

(54) ELECTROMAGNETIC PROBE

(75) Inventors: Patrice Brachat, Nice (FR); Frédéric Devillers, Nice (FR); Philippe Ratajczak, Nice (FR); Raymond Bills, Roquebrune Cap Martin (FR)

(73) Assignee: France Telecom (FR)

( * ) Notice: Subject to any disclaimer, the term of this patent is extended or adjusted under 35 U.S.C. 154(b) by 0 days.

(21) Appl. No.: 10/044,483

(22) Filed: Jan. 11, 2002

(65) Prior Publication Data

US 2002/0109497 A1 Aug. 15, 2002

(30) Foreign Application Priority Data

Jan. 12, 2001 (FR) ..... 01 00390

(51) Int. Cl.[7] ..... H01Q 13/00

(52) U.S. Cl. ..... 343/772; 343/771; 343/846; 324/95

(58) Field of Search ..... 324/95, 72.5; 343/725–728, 343/767–771, 783–785, 912–913, 792.5, 846

(56) References Cited

U.S. PATENT DOCUMENTS 3,919,710 A * 11/1975 Fletcher et al. ..... 343/770
4,143,377 A * 3/1979 Salvat et al. ..... 343/755
4,608,572 A * 8/1986 Blakney et al. ..... 343/792.5
5,467,095 A * 11/1995 Rodal et al. ..... 343/700 MS
6,084,551 A * 7/2000 Aslan ..... 343/725

FOREIGN PATENT DOCUMENTS

JP 02-121505 * 5/1990 ..... H01Q/9/28

* cited by examiner

*Primary Examiner*—Paresh Patel
(74) *Attorney, Agent, or Firm*—Blakely Sokoloff Taylor Zafman

(57) ABSTRACT

An electromagnetic probe having at least one assembly including in combination: a coaxial type connectio, a ground plane connected to the outer sheath of the coaxial connection, a reflector cone placed facing the ground plane and shaped to define impedance that is at least substantially constant along its profile, the reflector being electrically isolated, and a dielectric medium interposed at least in part between the reflector cone and the ground plane.

5 Claims, 7 Drawing Sheets

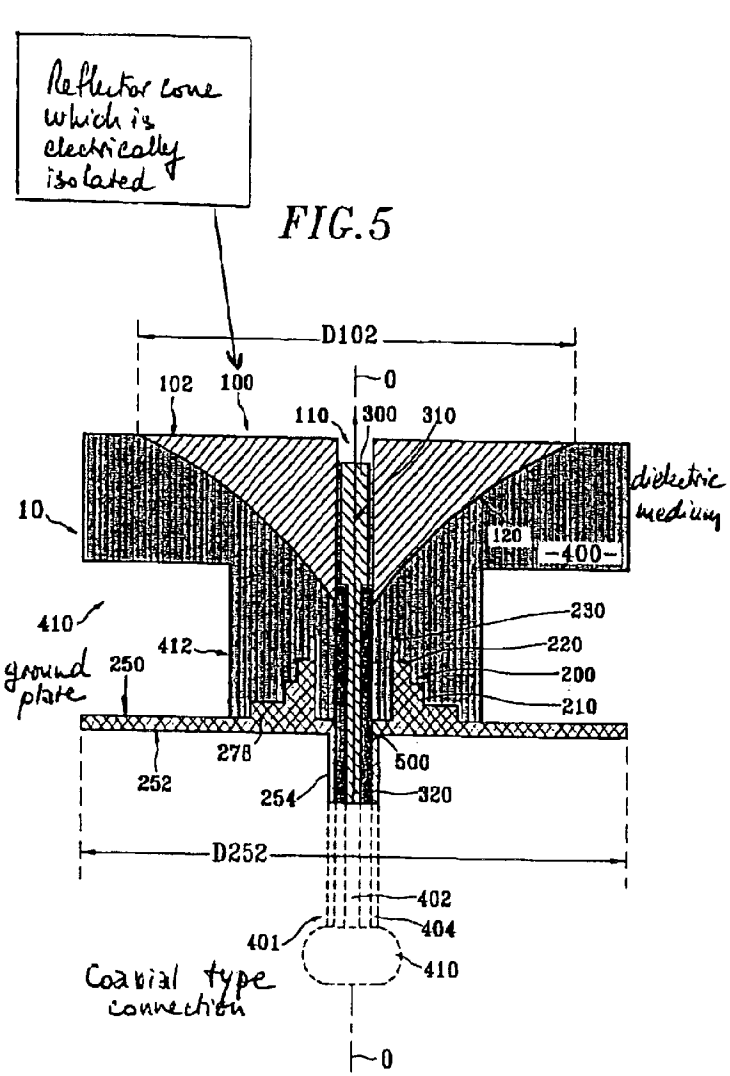
FIG. 5
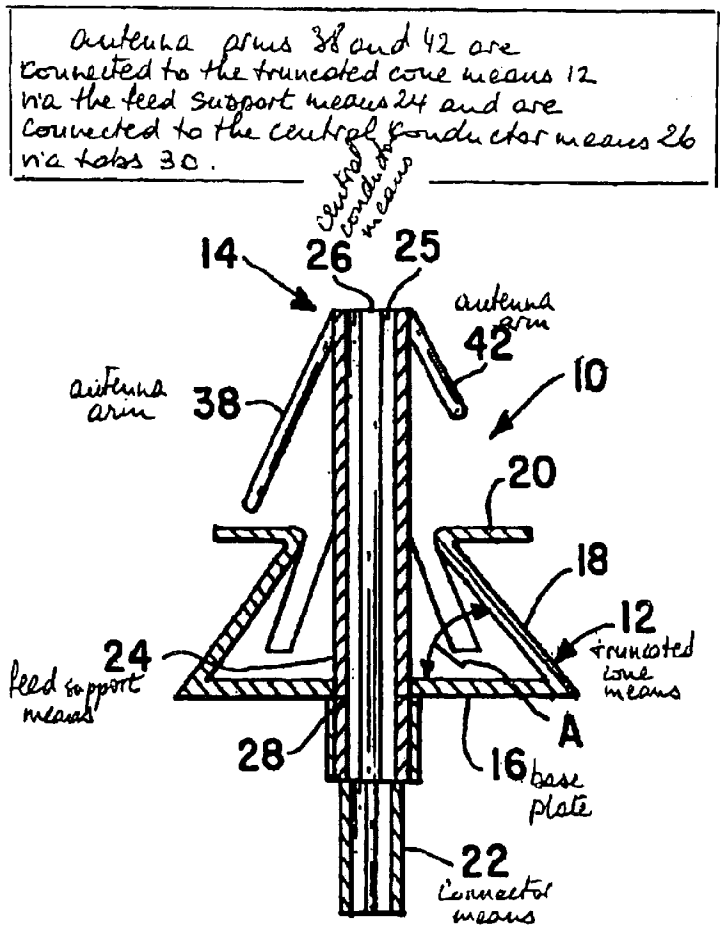

ELECTROMAGNETIC PROBE

The present invention relates to the field of electromagnetic probes or sensors.

BACKGROUND OF THE INVENTION

Numerous electromagnetic sensors or probes have already been proposed. Nevertheless, presently-known means do not always give full satisfaction.

In particular, it has not been possible until now to make probes of small size that are nevertheless capable of covering a broad measurement band: whatever solutions have been envisaged in known systems, any reduction in size (typically to less than one-quarter of the wavelength) is synonymous with reducing the passband.

In an attempt to mitigate that drawback, proposals have indeed been made to develop probes based on frequency-selective printed antennas by adding an active electronic circuit that compensates for said selectivity as a function of frequency. For that purpose, non-linear elements are associated with the antenna. Unfortunately, that solution puts a considerable limit on sensitivity and therefore makes it difficult to extract performance at a precise frequency.

OBJECTS AND SUMMARY OF THE INVENTION

A particular object of the present invention is to propose a novel electromagnetic probe presenting properties that are better than those of previous known probes.

A particular object of the present invention is to propose a probe that is compact and broadband.

Typically, the present invention seeks to cover at least two octaves, and to provide high sensitivity, i.e. a dynamic range of 30 decibels (dB) to 40 dB with a detection threshold of about 0.5 volts per meter (V/m).

In the context of the present invention, these objects are achieved by a probe comprising at least one assembly comprising in combination:

- a coaxial type connection;
- a ground plane connected to the outer sheath of the coaxial connection;
- a reflector cone placed facing the ground plane and shaped to define impedance that is at least substantially constant along its profile; and
- a dielectric medium interposed at least in part between the reflector cone and the ground plane.

According to other advantageous characteristics of the present invention, the above-specified assembly further comprises:

- a sleeve centered on the ground plane and placed facing the reflector cone; and
- a rod-shaped element passing at least partially through the reflector cone and constituting a matching stub, extending the central core of the coaxial connection.

The present invention also provides a probe comprising a combination of a plurality of assemblies of the above type, placed on multiple axes that are not mutually parallel so as to form a multidirectional probe, e.g. a three-axis electromagnetic probe that is isotopic, broadband, and compact, making it possible to measure simultaneously three orthogonal components of the electromagnetic field at a given point, without any privileged polarization.

BRIEF DESCRIPTION OF THE DRAWINGS

Other characteristics, objects, and advantages of the present invention will appear on reading the following detailed description and from the accompanying drawings, given as non-limiting examples, and in which:

FIG. 5 is a meridian section view showing the general structure of an antenna constituting a variant of the present invention, having a selected dielectric medium between the reflector cone and the ground plane;

MORE DETAILED DESCRIPTION

Figure 1:
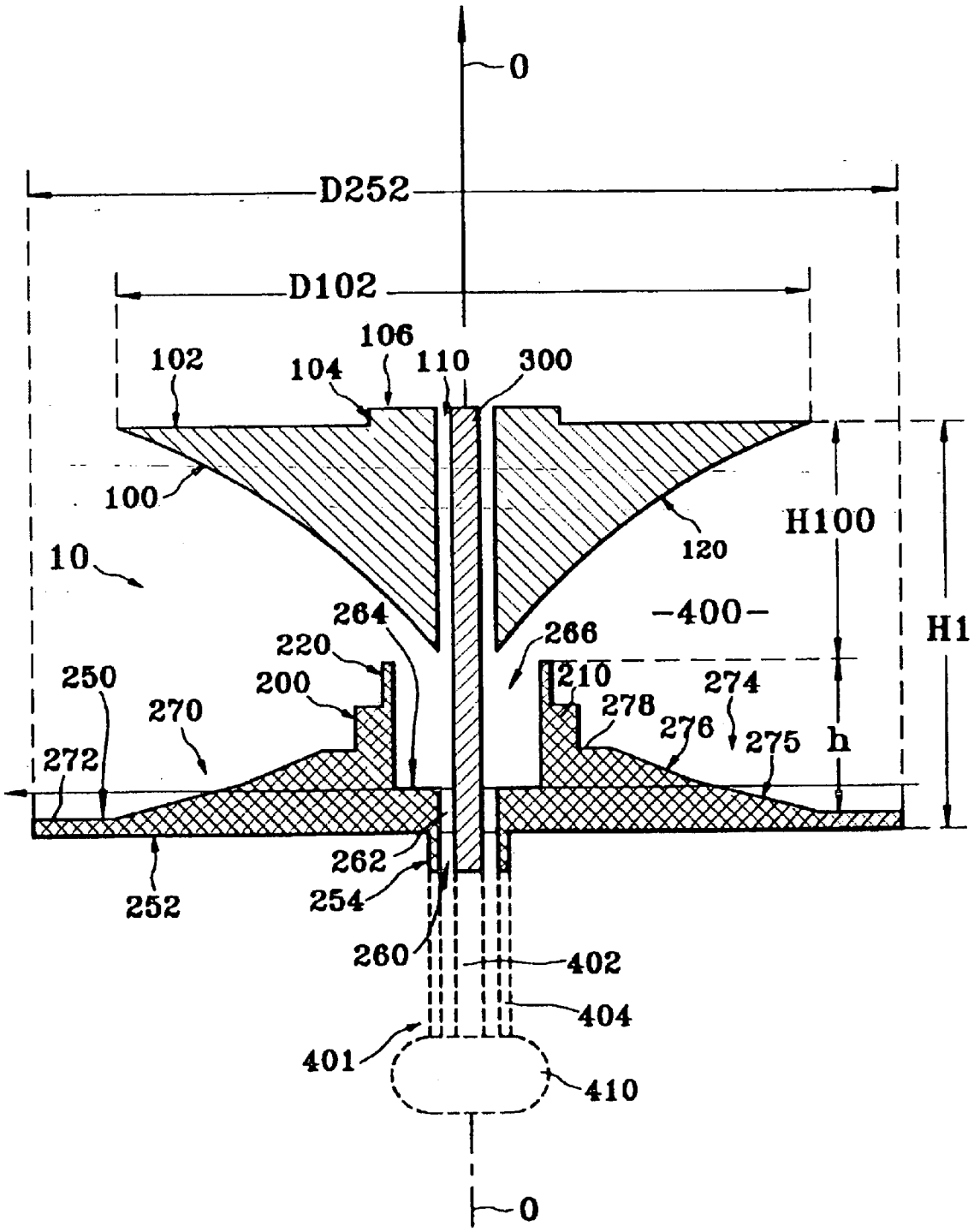
FIG. 1 is a meridian section view showing the general structure of an individual antenna in accordance with the present invention.

Accompanying FIG. 1 shows a broadband isotopic individual antenna 10 of the present invention and essentially comprising:

- a shaped reflector cone 100;
- a shaped sleeve 200;
- a ground plane 250;
- an element forming a matching stub 300 passing through the cone 100; and
- a dielectric medium 400 interposed between the reflector cone 100 on one side and the shaped sleeve 200 associated with the ground plate 250 on the other side.

As can be seen in FIG. 1, the antenna 10 of the invention preferably presents circular symmetry about an axis O—O.

The reflector cone 100 possesses a circular base surface 102 having the axis O—O passing therethrough. This circular base surface 102 is essentially plane and perpendicular to the axis O—O. In a variant, as shown in FIG. 1, the base surface 102 can possesses a cylindrical butt 104 projecting from its center and having a plane base 106, for example.

The base surface 102 corresponds to the face of the cone 100 that is furthest away from the sleeve 200 and the ground plane 250. Its diameter $D_{102}$ is equal to 97 millimeters (mm) for example.

The reflector cone 100 possesses a cylindrical through channel 110 of constant section. Its diameter can be about 9 mm.

The face 120 of the reflector 100 that faces towards the sleeve 200 and the ground plane 250 is generally conical, tapering towards the ground plane 250. More precisely, as shown in FIG. 1, this face 120 is defined by a curved generator line of continuous curvature with its concave side facing outwards. The sag of this generator line is typically about 4 mm.

The profile of this surface 120 is adapted (by progressive deformation towards free space) so as to define impedance that is at least substantially constant.

The axial height $H_{100}$ of the cone 100 (between its small end and its base face 102) is typically about 31 mm.

In the embodiment shown in FIG. 1, the sleeve 200 and the ground plane 250 are made as a single piece. Nevertheless, in a variant they could be made as two separate pieces and they need not necessarily be touching.

The reflector 100, the sleeve 200, and the ground plane 250 are made of an electrically conductive material, most advantageously out of a metal, e.g. aluminum.

The ground plane 250 is formed essentially by a plateau extending transversely relative to the axis O—O, with the sleeve 200 projecting from the center of the ground plane towards the reflector 100.

In FIG. 1, the ground plane 250 possesses a base surface 252 (its surface furthest away from the reflector 100) that is circular, plane, and perpendicular to the axis O—O, and it is provided in its center with a cylindrical wall 254 of small thickness and low height, forming an outer sheath for picking up the signal.

The diameter of the surface 252 is typically 120 mm.

By way of example, the radial thickness of the wall 254 is about 2 mm, and its axial height about 6 mm.

The wall 254 surrounds a through axial bore 260 that is stepped.

This bore 260 possesses two axially juxtaposed segments: a first segment of small section 262 which opens out to the face 252; and a second segment 266 of greater section which opens out to the face of the sleeve 200 that faces towards the reflector cone 100.

By way of example, the segment 262 has a diameter of about 8 mm and a length of about 11 mm. The diameter of the segment 262 is typically identical to the diameter of the bore 110 formed in the reflector cone 100.

By way of example the segment 266 has a diameter of about 21 mm and a length of about 17 mm.

The two segments 262 and 266 are interconnected by a step 264 in the form of a plane annulus perpendicular to the axis O—O and facing towards the cone 100.

The face 270 of the ground plane 250 that faces towards the reflector cone 100 can be implemented in various ways.

In FIG. 1, it comprises three main sectors: a radially outer sector 272, a middle sector 274, and a radially inner sector 278.

The sector 272 is defined by a plane annular surface perpendicular to the axis O—O. The radial width of this section 272 is typically about 11 mm.

Similarly, the radially inner sector 278 is defined by a plane annular surface perpendicular to the axis O—O. The radial width of this sector 278 is typically about 4.5 mm.

The middle sector 274 converges progressively towards the reflector cone 100 on going towards the axis O—O, i.e. from the outer sector 272 towards the inner sector 278. Its radial extent is about 27 mm. The middle sector 274 can be defined by a rectilinear generator line. Nevertheless, in the embodiment shown in FIG. 1, this middle sector 274 is defined by two adjacent segments 275 and 276 each of which is rectilinear, and which together form an obtuse angle of the order of 170°, with the concave side of this sector facing outwards.

The sleeve 200 projects from the radially inner sector 278 towards the reflector cone 100.

The sleeve 200 serves to decouple the connection point of the antenna from the ground plane 250, thus making the system easier to match.

The sleeve 200 can be implemented in various ways. In FIG. 1, it comprises two axially juxtaposed cylinders: a first cylinder 210 followed by a second cylinder 220 of smaller section.

Typically, the outside diameter of the first cylinder 210 is about 32 mm and its axial length is about 6 mm.

Typically, the outside diameter of the second cylinder 220 is about 23 mm and its axial length is about 5 mm.

The cylinders 210 and 220 both have the same inside diameter which corresponds to the second segment 266 of the bore 260.

As can be seen in FIG. 1, the plane extending transversely to the axis O—O and defined by the top of the cylinder 220 preferably coincides with the transverse plane defined by the small end of the reflector cone 100.

The axial distance $H_1$ between the faces 102 and 252 is typically 54 mm.

The stub 300 comprises an electrically conductive rectilinear bar, preferably made of metal, which extends the central core 402 of the coaxial connection. It is engaged in the bores 110 of the reflector 100 and 260 of the ground plane 250 and of the sleeve 200.

This element 300 thus behaves like a series stub which enables the value of the input impedance to be adjusted and which provides an additional parameter enabling bandwidth to be enlarged.

The length of the stub 300 is equal to the distance between the two opposite outer faces of the device defined by the butt 104 and the wall or sheath 254.

The stub 300 is connected at the sheath 254 to the central core 402 of a coaxial feeder line 401 whose outer shielding 404 is connected to the sheath 254. The diameter of the stub 300 is typically about 4 mm. This diameter must be smaller than the diameter of the bore 110 so that the stub 300 can be centered in the bores 110 and 262, without touching the cone 100 and without touching the ground plane 250.

The coaxial feeder line 401 is shown in diagrammatic manner only in FIG. 1. It is connected using any appropriate connector and/or appropriate operating system represented by reference 410.

The dielectric medium 400 situated between the reflector cone 100 and the ground plane 250 together with the sleeve 200 can be implemented in numerous ways. It can be constituted by air. Nevertheless, as explained below, it is preferably a dielectric material having permittivity greater than 1.

Figure 2:
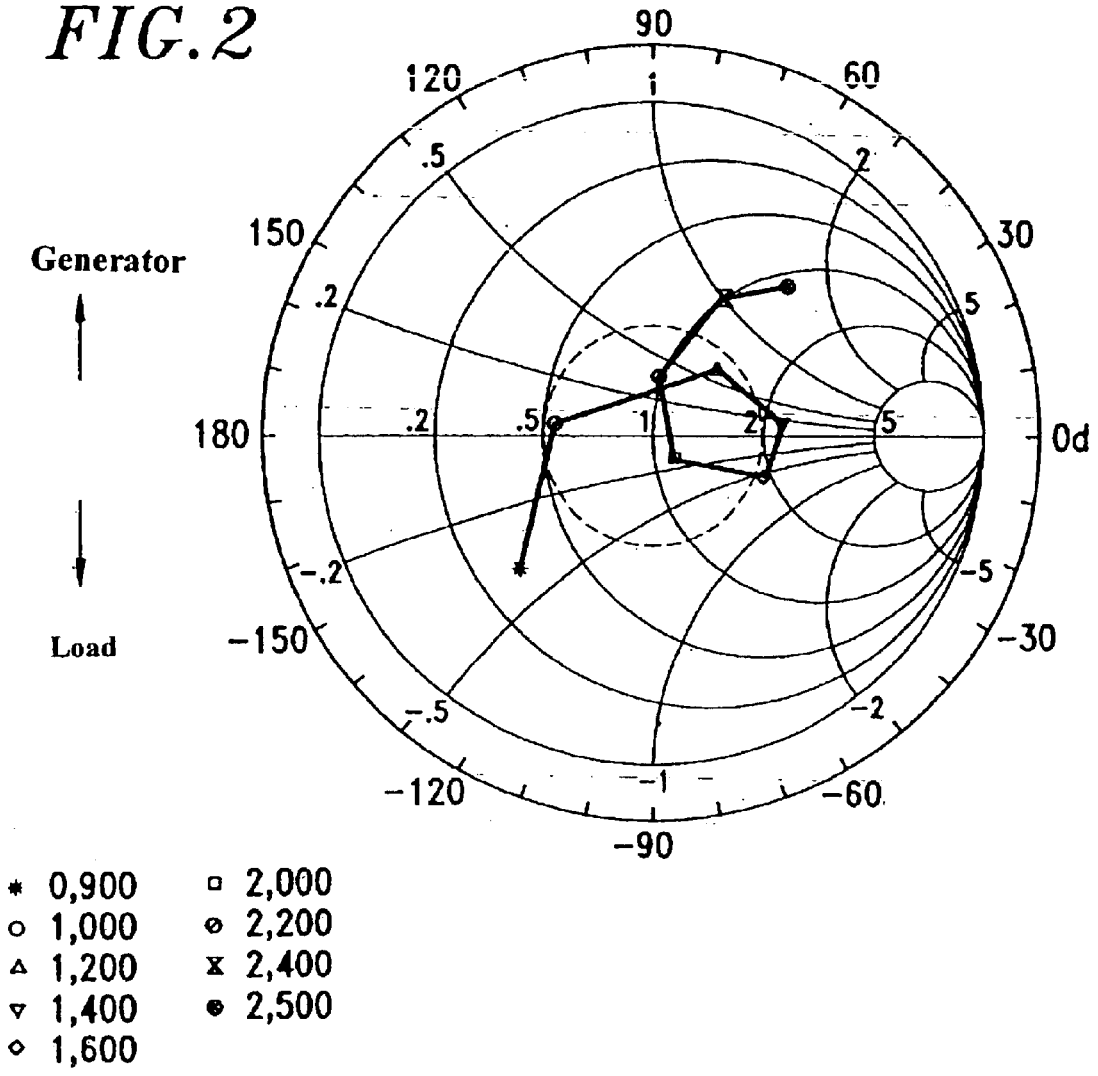
FIG. 2 is a Smith chart for the broadband isotopic individual antenna shown in FIG. 1.
Figure 3:
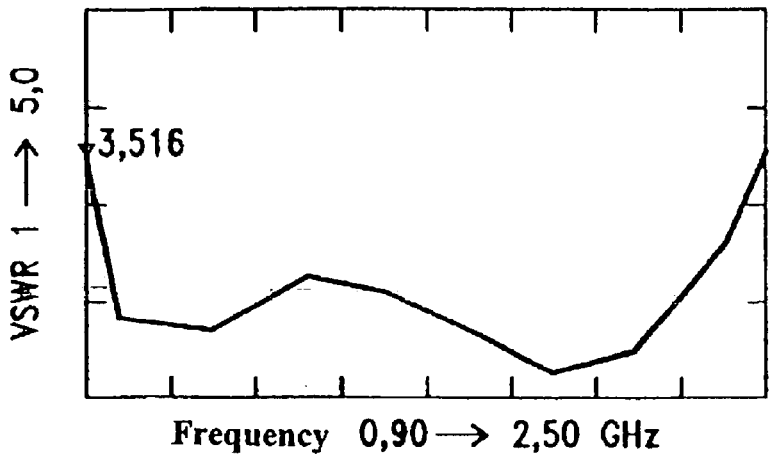
FIG. 3 shows the standing wave ratio (SWR) of said antenna.

As can be seen on examining accompanying FIGS. 2 and 3, the antenna structure of the present invention as described above makes it possible to optimize the matching loop so as to conserve an SWR of less than 4 over nearly 200% of the band. This is remarkable for a structure whose maximum size (120 mm for the ground plane 250) remains about one-third of a wavelength at 0.9 GHz.

Figure 4:
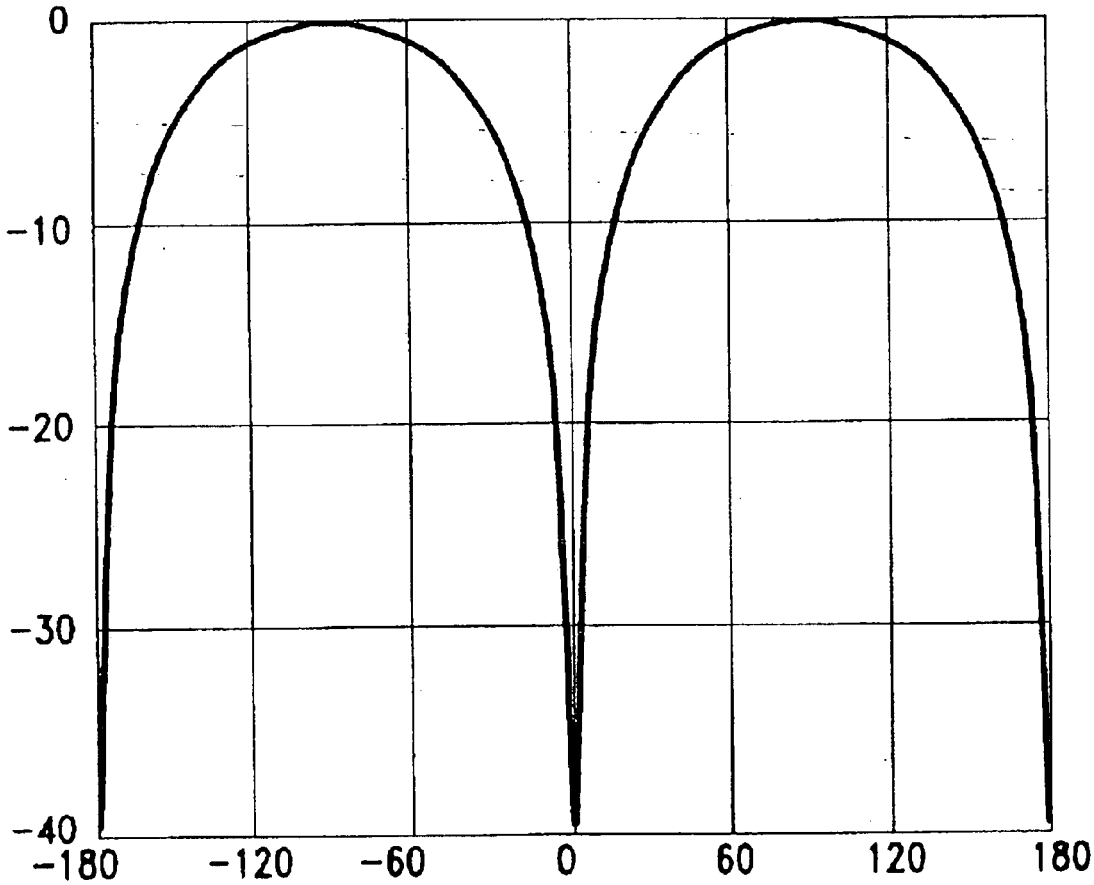
FIG. 4 shows the radiation pattern of the broadband isotopic individual antenna shown in FIG. 1, measured at a frequency of 1 gigahertz (GHz)

The individual antenna 10 is a body of revolution about the axis O—O so its radiation pattern is circularly symmetrical about said axis and on all sections containing the axis O—O the pattern has the appearance shown in FIG. 4: this is a typical dipole pattern with zero field on the axis O—O and a radiation maximum at 90° to said axis, i.e. in the direction of the ground plane.

Accompanying FIG. 5 is a similar meridian section view showing a variant embodiment which constitutes a preferred embodiment of the invention. Overall it is similar to FIG. 1, but it possesses a dielectric medium 400 of selected permittivity which is interposed between the reflector cone 100 and the ground plane 250 so as to further reduce the size of the radiating element.

Typically, the dielectric material 400 possesses dielectric permittivity close to 4. This variant makes it possible to reduce the overall size of the individual antenna to 80 mm, i.e. to one-quarter of the wavelength at 900 megahertz (MHz), while maintaining the desired radio performance. The reflector cone 100 shown in FIG. 5 is generally similar to that of FIG. 1. Nevertheless, it will be observed that it does not have a butt 104. Its outside diameter $D_{102}$ is about 72 mm.

In the embodiment shown in FIG. 5, the ground plane 250 is constituted by a generally plane plate possessing an outside diameter $D_{252}$ of about 80 mm and an axial thickness of about 2 mm.

In FIG. 5, the wall 254 projecting from the face of the ground plane 250 that faces away from the reflector cone 100 and designed to be connected to the outer sheath 404 of the coaxial connection 401 typically possesses an outside diameter of about 6.5 mm, an inside diameter of about 4 mm, and an axial height of about 6.5 mm.

The ground plane 250 shown in FIG. 5 is provided on its face looking towards the reflector cone 100, and in its center, with a cylinder 278 having a plane base and typically having an outside diameter of about 30 mm, an inside diameter of about 9.5 mm, and an axial height of about 2.5 mm.

In the embodiment shown in FIG. 5, the shaped sleeve 200 comprises three cylinders 210, 220, and 230 projecting from the face of the ground plane 250 that looks towards the reflector cone 100. The outside diameters of these cylinders 210, 220, and 230 decrease from one cylinder to the next, on approaching the reflector cone 100.

Typically:

- the first cylinder 210 has an outside diameter of about 19 mm and an axial height of about 2.5 mm;
- the second cylinder 220 has an outside diameter of about 14 mm and an axial height of about 2.5 mm;
- the first cylinder 230 has an outside diameter of about 11 mm and an axial height of about 2.5 mm; and
- the inside diameters of all three cylinders 210, 220, and 230 are identical and equal to the inside diameter of the cylinder 278 formed on the plate of the ground plane 250, being about 9.5 mm.

The dielectric material 400 can fill all of the space defined between the reflector cone 100 and the ground plane 250 associated with the shaped sleeve 200.

Nevertheless, as shown in FIG. 5, it is preferable for the dielectric material 400 to be provided with a step or annular groove 410 in its bottom portion adjacent to the ground plane 250. This disposition makes it possible to avoid excessive mismatch between the dielectric material and free space.

Typically, this annular groove 410 is rectangular in section with its bottom 412 being parallel to the axis O—O. The annular groove which is preferably filled merely with air opens out radially to the outside of the dielectric material 400. Typically, the inside diameter of the groove 410 is about 36 mm and its axial height is about 19.5 mm.

Furthermore, as shown in FIG. 5, the matching stub 300 can be made up of a plurality of segments possessing different diameters. In the embodiment of FIG. 5, the matching stub 300 comprises two segments 310 and 320.

The first segment 310 is placed in the bore 110 of the reflector cone 100. Typically, its axial length is about 189 mm and its outside diameter is about 3 mm. It will be observed that the end face of this first segment 310 of the stub 300 is set back from the outside face 102 of the reflector cone 100.

The second segment 320 of the stub 300 possesses a smaller outside diameter. It is situated in the central portion of the dielectric material 400 and it passes through the ground plane 250 and the wall 254 associated therewith. Typically, the second segment 320 possesses an axial length of about 25 mm and an outside diameter of about 1.5 mm.

On examining accompanying FIG. 5, it will also be observed that there is a sleeve or bushing 500 possessing dielectric permittivity $\epsilon_2$ located around the second segment 320 of the stub 300. Typically, this dielectric sleeve or bushing 500 possesses an inside diameter of about 1.5 mm and an outside diameter of about 4 mm, having an axial length of about 25 mm.

Figure 6:
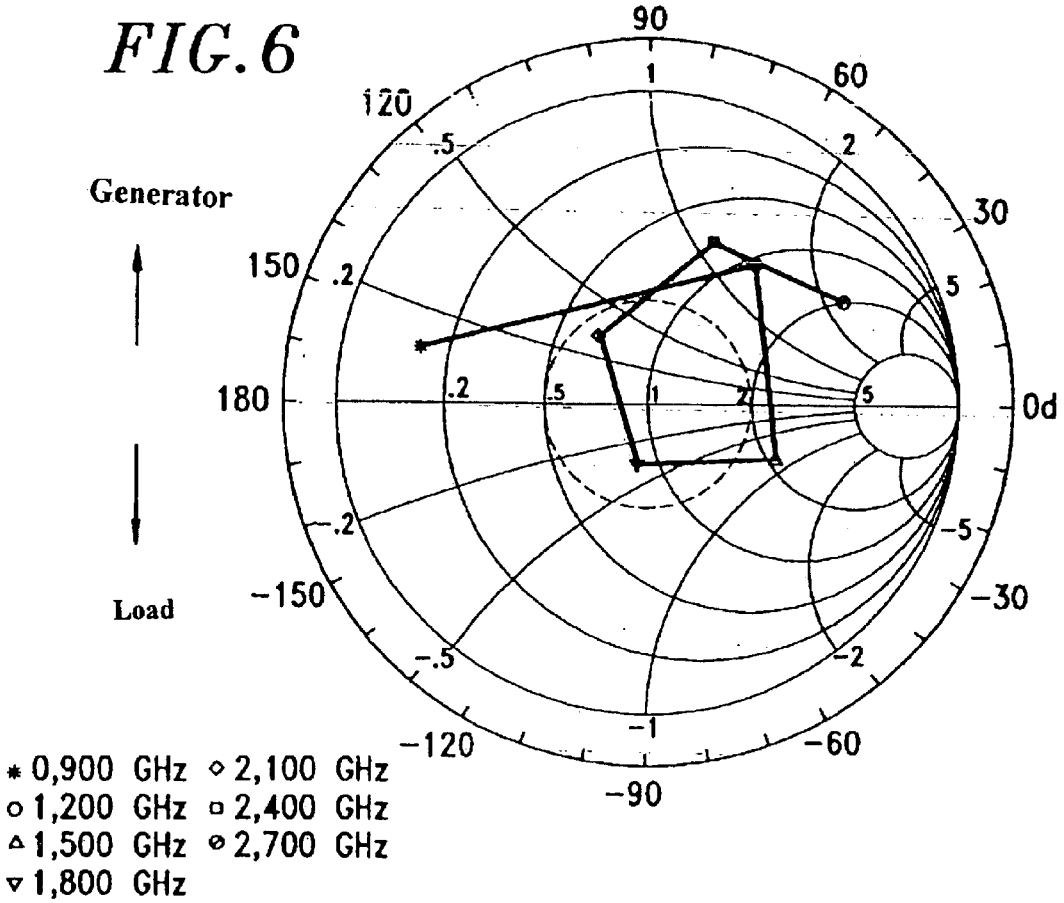
FIG. 6 shows the Smith chart for the broadband isotopic individual antenna shown in FIG. 5.
Figure 7:
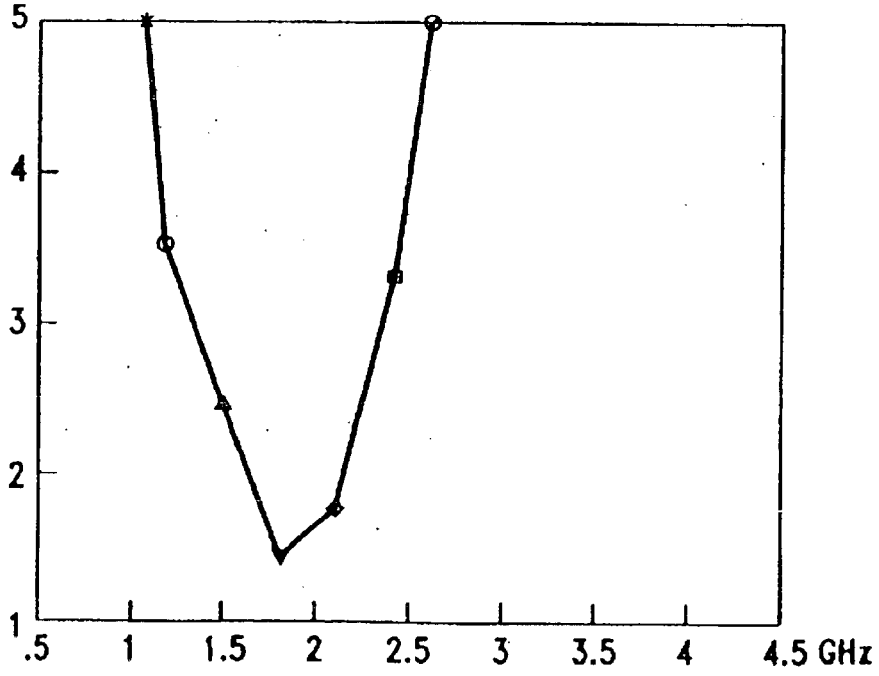
FIG. 7 shows the SWR of said antenna.

The Smith chart and the SWR of the individual antenna shown in FIG. 5 and described above are shown respectively in accompanying FIGS. 6 and 7.

Figure 8:
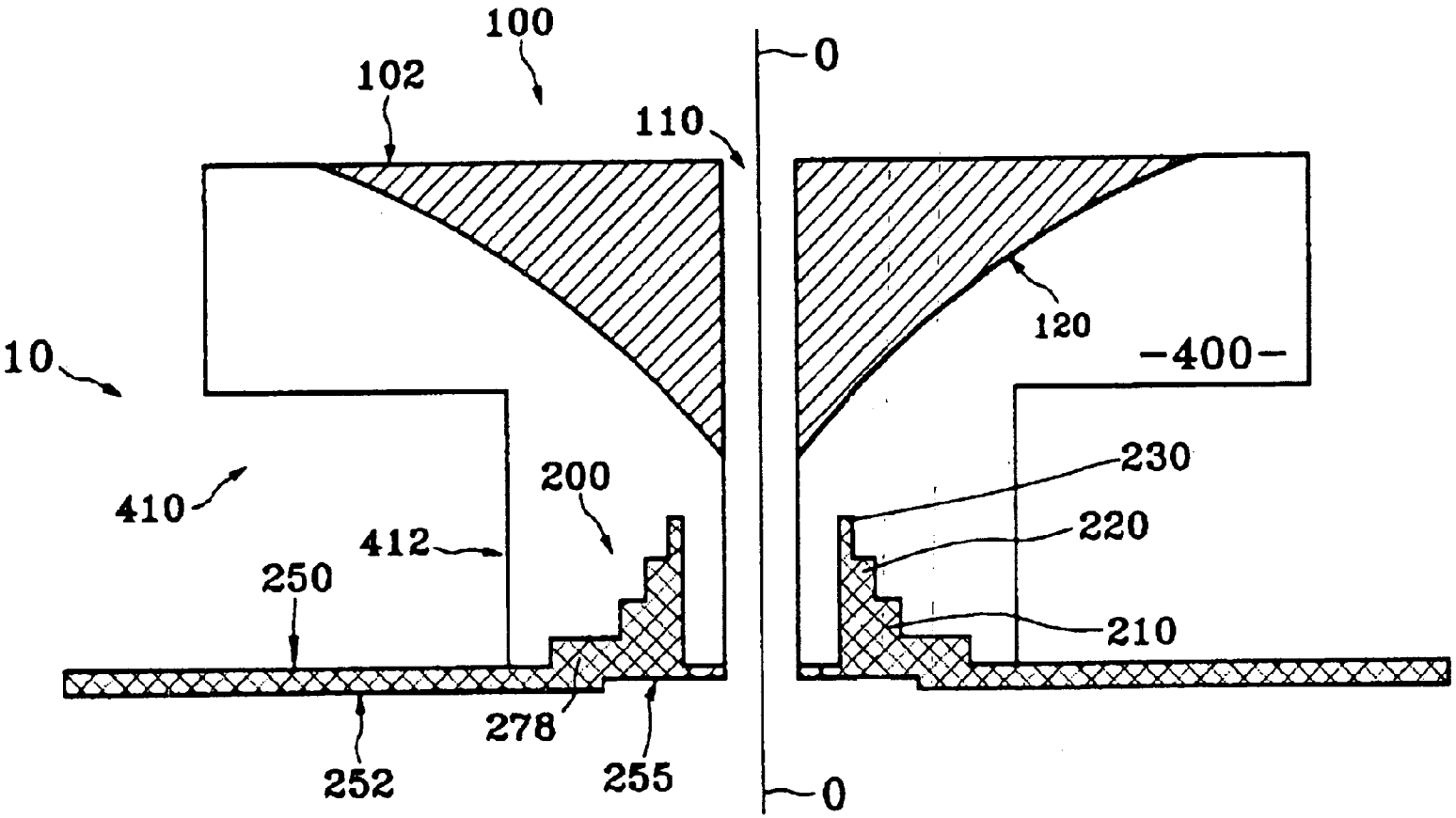
FIG. 8 is a similar section view containing a meridian and showing the general structure of another variant of the antenna of the present invention.

FIG. 8 shows a variant embodiment which differs from the embodiment described above and shown in FIG. 5 essentially by eliminating the wall 254 which is replaced by a setback 255 formed in the face 252 of the ground plane 250 that faces away from the reflector cone 100.

By way of non-limiting example, in this variant embodiment:

- the dielectric material 400 has permittivity of about 4, an outside diameter of about 80 mm, and an axial height above the groove 410 of about 19.6 mm, the groove 410 having an axial height of about 19.6 mm and a radial depth of about 22 mm;
- the ground plane 250 and the sleeve 200 comprise four cylinders 278, 210, 220, and 230 that are generally similar in shape and size to the dispositions described above with reference to FIG. 5; and
- the shaped conical surface 120 has an inside radius of about 2 mm in its zone adjacent to the sleeve 200, and an outside radius of about 36.3 mm in its zone furthest away therefrom and coinciding with the base plane 102; this shaped surface 120 can be considered as a succession of eight segments each having an angle θ relative to the axis O—O that increases progressively on going away from the ground plane 250, with the respective slopes θ and the coordinates of the origin rings for each of these eight segments considered in order from the central axis O—O and starting from the base plane 102 being typically but in non-limiting manner as follows:
- for the first segment: $\theta_1=35°$, $x_1=2.06$ mm, and $z_1=25.667$ mm;
- for the second segment: $\theta_2=40°$, $x_2=4.6274$ mm, and $z_2=22$ mm;
- for the third segment: $\theta_3=45°$, $x_3=7.7041$ mm, and $z_3=18.3334$ mm;
- for the fourth segment: $\theta_4=50°$, $x_4=11.3608$ mm, and $z_4=14.6667$ mm;
- for the fifth segment: $\theta_5=55°$, $x_5=15.7406$ mm, and $z_5=11$ mm;
- for the sixth segment: $\theta_6=60°$, $x_6=20.9771$ mm, and $z_6=7.3333$ mm;
- for the seventh segment: $\theta_7=65°$, $x_7=27.328$ mm, and $z_7=3.6666$ mm; and
- for the eighth segment: $\theta_8=70°$, $x_8=31.2596$ mm, and $z_8=1.8333$ mm.

As mentioned above, to enable multiple components of the electromagnetic field to be detected simultaneously, the present invention also proposes a probe comprising a plurality of individual antennas of the above-described type, disposed on multiple axes that are not mutually parallel. Typically, the ground planes 250 bear against the outside faces of a polyhedron of selected shape.

Figure 9:
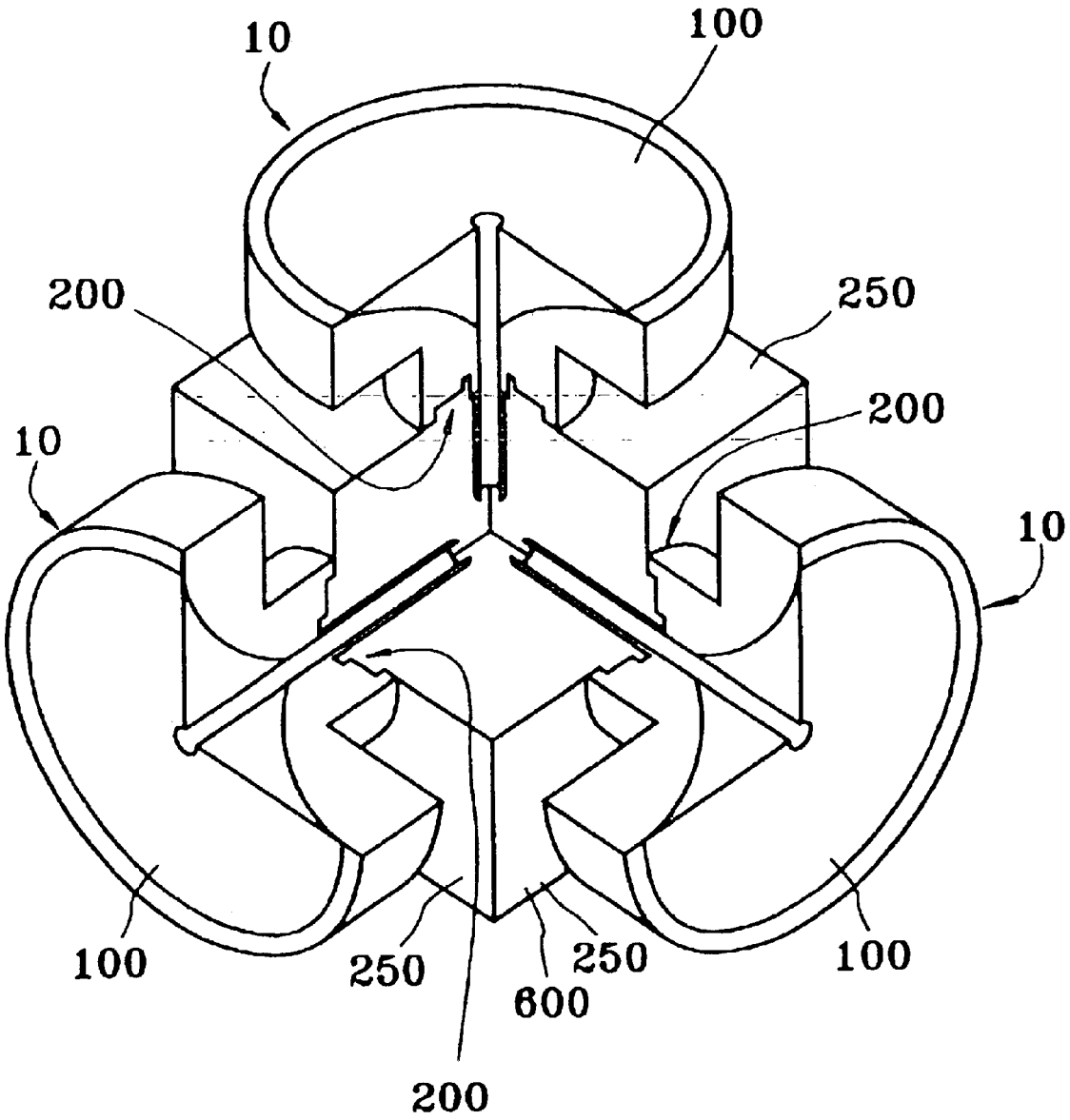
FIG. 9 is a diagrammatic fragmentary perspective view of a three-axis probe of the present invention and comprising three individual antennas.

More precisely still, in the context of the present invention, the probe proposed in this way is an electromagnetic probe having three axes, which probe is isotropic, broadband, and compact, being made up of three individual antennas 10 of the type described above with reference to FIGS. 1 to 8 and disposed on three axes that are mutually orthogonal in pairs. As shown in FIG. 9, the ground planes 250 of these three individual antennas lie in three faces adjacent to a corner of a cube 600, with the axes O—O of the individual antennas being orthogonal to the corresponding faces of the cube and with the respective reflector cones 100 being disposed outside the ground planes 250.

Such a three-axis probe can be used to detect three orthogonal components of an electromagnetic field simultaneously, thereby making it possible to reconstitute the field coming from any polarization.

The inventors have shown that when combining a plurality of individual antennas 10 as shown in FIG. 9, coupling between the various elements does not degrade performance. Furthermore, diffraction by the edges of the cube 600 does not spoil the isotropic nature of the radiation patterns.

On the contrary, this combination leads to the passband being enlarged towards low frequencies. It turns out that the presence of the cube 600 made out of an electrically conductive material, or more generally the presence of a polyhedron integrated in the ground planes 250, serves to increase the effective volume of the probe and thus enlarges its bandwidth towards lower frequencies.

Naturally, the present invention is not limited to the particular embodiment described above but extends to any variant in the spirit of the invention.

The present invention has numerous applications.

It applies in particular to measuring electromagnetic field in order to monitor compliance with environmental standards, e.g. on equipment that is being qualified.

The present invention can be used in particular for measuring simultaneously fields in the GSM, DCS, and UMTS bands used for mobile telephones, i.e. bands in the range 0.9 GHz to 2.7 GHz.

The description above relates to a shaped conical surface 120 defined by a concave generator line. In a variant, the generator line defining the shaped surface 120 could be convex or rectilinear, depending on the environment and the desired matching.

Naturally, the invention is not limited to the sleeve 200 and the ground plane 250 having the particular shapes illustrated in the accompanying figures and described above.

Similarly, the invention is not limited to its dielectric insert 400 having the shape shown and described above.

The element 300 constituting the matching stub can be associated with any suitable type of termination, e.g. a short circuit, an open circuit, line segments of greater or smaller thickness, adjustable terminal capacitors (varactors), irises (steps), or adjustable screws, etc.

A probe structure is mentioned above comprising three orthogonal individual antennas bearing on faces defining a corner of a cube. Nevertheless, the invention can be generalized to any type of polyhedron when designing multiband, multiply polarized, etc., probes.

In particular, all of the dimensional values specified in the present description should be considered merely as indications concerning non-limiting embodiments of the present invention.

What is claimed is:

1. An electromagnetic probe comprising at least one assembly comprising in combination:

a coaxial type connection;

a ground plane connected to the outer sheath of the coaxial connection;

a reflector cone placed facing the ground plane and shaped to define impendance that is at least substantially constant along its profile; and a dielectric medium interposed at least in part between the reflector cone and the ground plane, wherein the reflector cone has a profiled surface defined by a generator line that is concave towards the ground plane.

2. A probe according to claim 1, further comprising a sleeve connected to the central part of the ground plane and placed facing the reflector cone.

3. A probe according to claim 1, wherein the assembly is circularly symmetrical about a central axis.

4. A probe according to claim 1, wherein the dielectric medium is circularly symmetrical about a central axis and possesses permittivity greater than 1.

5. A probe according to claim 1, wherein the dielectric medium substantially fills the space lying between the reflector cone and the ground plane, with the exception of a peripheral zone adjacent to the ground plane.

* * * * *